US010208538B2

(12) United States Patent
Astor et al.

(10) Patent No.: US 10,208,538 B2
(45) Date of Patent: Feb. 19, 2019

(54) PIPE TRADESMAN'S LADDER AND METHOD

(75) Inventors: Kyle G. Astor, Meadville, PA (US); James J. Grebinoski, Mercer, PA (US); Brett Latimer, New Castle, PA (US)

(73) Assignee: Werner Co., Greenville, PA (US)

( * ) Notice: Subject to any disclaimer, the term of this patent is extended or adjusted under 35 U.S.C. 154(b) by 1056 days.

(21) Appl. No.: 11/416,967

(22) Filed: May 3, 2006

(65) Prior Publication Data

US 2007/0193829 A1 Aug. 23, 2007

Related U.S. Application Data

(63) Continuation-in-part of application No. 11/358,626, filed on Feb. 21, 2006, now Pat. No. 7,886,872.

(51) Int. Cl.
*E06C 7/14* (2006.01)
*E06C 1/18* (2006.01)

(52) U.S. Cl.
CPC . *E06C 7/14* (2013.01); *E06C 1/18* (2013.01)

(58) Field of Classification Search
USPC ..... 182/129
See application file for complete search history.

(56) References Cited

U.S. PATENT DOCUMENTS 529,871 A * 11/1894 miner ..... E06C 7/182 182/106
868,694 A * 10/1907 parks ..... F16L 3/14 122/510
998,112 A * 7/1911 murray ..... H01B 17/16 174/149 R
1,672,717 A * 6/1928 Gentner ..... B62B 1/20 182/21
1,794,700 A 3/1931 McCaskey
2,088,895 A * 8/1937 Connell ..... E06C 1/12 182/206
2,166,255 A * 7/1939 Ligon ..... E06C 1/39 182/126
2,398,617 A * 4/1946 Casey ..... E06C 7/081 15/268
2,801,886 A * 8/1957 Peterson ..... E06C 7/16 182/121
2,871,067 A * 1/1959 Brogdon ..... E06C 7/16 182/121
3,363,864 A * 1/1968 Olgreen ..... F16L 3/04 248/68.1
3,477,679 A 11/1969 Lovitz
3,511,338 A * 5/1970 Chapman ..... E06C 7/16 182/121
3,693,754 A * 9/1972 Butler ..... 182/86
3,698,511 A * 10/1972 Dohan ..... 182/113
3,887,034 A * 6/1975 Sawatzky ..... E06C 7/14 182/129

(Continued)

FOREIGN PATENT DOCUMENTS

JP 2002227575 A * 8/2002
JP 2002227575 A * 8/2002

*Primary Examiner* — Katherine W Mitchell
*Assistant Examiner* — Candace L Bradford
(74) *Attorney, Agent, or Firm* — Ansel M. Schwartz

(57) ABSTRACT

A stepladder includes a pipe/tube holder attached to the rear side for holding pipe and/or a strap bender attached to a rail or a rear rung through which a strap is inserted to be bent, and/or a utility hook attached to the rear side. A method for cutting a pipe. A method for using a tool. A method for bending a strap.

4 Claims, 8 Drawing Sheets

(56) References Cited

U.S. PATENT DOCUMENTS 3,901,064 A * 8/1975 Jacobson ..... B21D 7/022 72/219
3,915,189 A 10/1975 Holbrook et al.
4,079,814 A * 3/1978 Larson ..... E06C 1/20 182/124
D248,777 S * 8/1978 Spencer ..... D25/68
4,111,027 A * 9/1978 Bottomley ..... B21D 5/042 72/320
4,167,865 A * 9/1979 Powell ..... B21D 7/063 269/228
4,176,580 A 12/1979 Gallegos
4,261,435 A 4/1981 Winter
4,311,209 A * 1/1982 Primerano ..... E06C 1/36 182/107
4,318,454 A * 3/1982 Johnson ..... E06C 7/14 182/129
4,355,700 A * 10/1982 Matthews et al. ..... 182/83
4,407,478 A * 10/1983 Hodges ..... F16L 3/237 248/542
4,424,752 A * 1/1984 Aberg ..... 108/57.3
4,488,424 A * 12/1984 McBride ..... B21D 5/042 72/387
4,609,167 A * 9/1986 Dean ..... B64D 9/00 244/118.1
4,630,709 A * 12/1986 Taylor ..... 182/48
4,653,608 A * 3/1987 Casada ..... E06C 7/143 182/121
4,653,713 A 3/1987 Hamilton
4,714,162 A * 12/1987 Harrison ..... E06C 7/14 182/129
4,759,162 A * 7/1988 Wyse ..... 52/126.6
4,815,684 A * 3/1989 Kellstadt ..... E06C 7/14 248/210
4,858,869 A 8/1989 Stang
4,862,994 A 9/1989 Hughes, Sr.
4,919,230 A * 4/1990 Langer et al. ..... 182/186.8
4,995,578 A * 2/1991 Monheim ..... E06C 7/14 182/129
5,035,389 A 7/1991 Wang
5,052,581 A 10/1991 Christ et al.
5,100,086 A * 3/1992 Rinderer ..... H02G 3/263 248/49
5,150,938 A 9/1992 Gans
5,158,023 A 10/1992 Allen
D334,240 S 3/1993 Huffine
5,240,214 A 8/1993 Birnbaum et al.
5,259,480 A 11/1993 Bartnicki et al.
5,263,550 A * 11/1993 Jines ..... E04G 21/3233 182/113
5,351,730 A 10/1994 Lewellen et al.
5,358,070 A 10/1994 Bartnicki et al.
5,370,263 A 12/1994 Brown
5,419,409 A 5/1995 Corulla
5,429,205 A * 7/1995 Collins ..... E06C 7/14 182/122
5,433,416 A 7/1995 Johnson
5,460,241 A 10/1995 LaBelle
5,503,245 A 4/1996 Etesam
5,544,718 A * 8/1996 Schumacher ..... E06C 7/14 182/129
5,547,080 A 8/1996 Klimas
D374,937 S * 10/1996 Salas ..... D25/68
5,573,081 A 11/1996 Bartnicki et al.
5,584,357 A 12/1996 Gugel et al.
5,622,278 A 4/1997 Fries et al.
5,628,381 A * 5/1997 Markovich et al. ..... 182/107
5,653,459 A * 8/1997 Murphy ..... 280/166
5,673,885 A * 10/1997 Pham ..... E06C 7/14 182/129
5,740,883 A 4/1998 Trank
5,782,314 A 7/1998 Zeitler
5,791,607 A * 8/1998 Thibault ..... F16L 3/221 248/58
5,797,571 A * 8/1998 Brophy ..... E06C 7/14 182/129
5,899,420 A 5/1999 Gerardi
5,924,615 A 7/1999 McGarrah
5,992,564 A * 11/1999 Kirkpatrick ..... E06C 7/48 182/117
6,024,192 A * 2/2000 Griffin ..... B25B 1/2484 182/129
D422,717 S 4/2000 Bartnicki et al.
6,085,867 A * 7/2000 Daniel et al. ..... 182/151
6,089,351 A * 7/2000 Ahl ..... E06C 7/14 182/129
6,089,383 A 7/2000 Heneveld
6,367,744 B1 * 4/2002 Ebersole ..... F16L 3/24 24/458
6,401,862 B1 6/2002 Caron
6,412,601 B1 7/2002 Schmidt
6,443,260 B1 9/2002 Katz et al.
6,454,050 B2 * 9/2002 Gibson et al. ..... 182/161
6,467,577 B1 10/2002 Charlebois, Jr.
6,481,583 B1 11/2002 Black et al.
6,502,664 B1 * 1/2003 Peaker, Sr. ..... E06C 7/14 182/129
6,585,204 B1 * 7/2003 Haertzen ..... E06C 7/14 182/129
6,591,941 B1 * 7/2003 Mannie ..... 182/129
6,810,995 B2 * 11/2004 Warford ..... 182/115
D500,145 S 12/2004 Cromberg
6,880,794 B1 4/2005 Kahn
6,912,886 B1 * 7/2005 Maes ..... B21D 7/022 72/217
6,942,063 B1 * 9/2005 Huett, Jr. ..... E06C 7/14 182/121
7,063,187 B1 6/2006 Lavigne
7,077,238 B2 * 7/2006 Butler ..... E06C 7/14 182/121
D530,025 S 10/2006 Patton et al.
D531,322 S 10/2006 Patton et al.
7,143,629 B1 * 12/2006 Chiu ..... B21D 7/063 72/459
7,159,694 B2 1/2007 Gibson
D538,634 S * 3/2007 King ..... D8/380
D541,433 S 4/2007 Wise
D557,093 S * 12/2007 Holt ..... D8/51
7,341,259 B1 3/2008 Slabich et al.
7,500,335 B1 * 3/2009 Kjose ..... 52/182
7,836,743 B1 * 11/2010 McCoy ..... B21D 5/042 72/319
7,850,177 B2 * 12/2010 Gilhuly ..... B62B 9/28 280/47.19
7,975,856 B2 * 7/2011 Gilpatrick ..... B08B 3/026 211/70.6
8,016,078 B2 * 9/2011 Astor ..... E06C 1/39 182/129
2002/0017430 A1 2/2002 Rosko
2002/0185576 A1 * 12/2002 Harper ..... E06C 7/14 248/210
2003/0196855 A1 * 10/2003 Kvam ..... E06C 7/14 182/129
2003/0213646 A1 * 11/2003 Gallion ..... E06C 7/14 182/129
2003/0230452 A1 * 12/2003 Campagna ..... E06C 1/393 182/129
2005/0150724 A1 7/2005 Snider et al.
2007/0084669 A1 * 4/2007 Campagna et al. ..... 182/129
2007/0193829 A1 * 8/2007 Astor ..... E06C 7/14 182/129
2008/0142300 A1 * 6/2008 Roberge ..... E06C 7/14 182/129
2008/0202391 A1 * 8/2008 Pisano ..... 108/57.25
2009/0078504 A1 * 3/2009 Astor ..... E06C 1/39 182/129
2010/0326771 A1 * 12/2010 Kreller ..... 182/222
2011/0198153 A1 * 8/2011 Dufour et al. ..... 182/113

* cited by examiner

PIPE TRADESMAN'S LADDER AND METHOD

This application is a continuation-in-part of copending application Ser. No. 11/358,626 filed on Feb. 21, 2006.

CROSS-REFERENCE

This application is related to contemporaneously filed U.S. patent application having Ser. No. 11/416,961, titled "Pipe Tradesman's Ladder Top and Method", by Kyle G. Astor, incorporated by reference herein.

FIELD OF THE INVENTION

The present invention is related to a pipe tradesman ladder. More specifically, the present invention is related to a pipe tradesman ladder preferably having a pipe/tube holder, a utility hook and a strap bender.

BACKGROUND OF THE INVENTION

For years, stepladders have been designed for the general construction and painting professionals needs. Bauer Corporation provides a ladder vise, U.S. Pat. No. 4,318,454 that attaches to a stepladder to hold materials securely. This vise requires the user to first operate the vise on one side and place the conduit in and then open the opposite side and place the conduit in to hold it firmly. This holder is a spring loaded sliding design that will hold a variety of materials.

For years, stepladders have been designed for the general construction and painting professionals needs. The new Werner Pipe Trade ladder is designed for the specific needs of the Pipe of piping tubing, and slots and hooks for tool storage. These added features help make the user's job safer and more efficient.

Bauer ladders developed and patented a Ladder Vise in 1981, U.S. Pat. No. 4,318,454. Their design requires the user to first operate the vise on one side and place the pipe/tube in and then open the opposite side and place the other end of the pipe/tube in to hold it firmly. Their holder is a spring loaded sliding design that will hold a variety of materials.

SUMMARY OF THE INVENTION

The present invention pertains to a stepladder. The stepladder comprises a front side. The front side comprised of a first front rail, and a second front rail in parallel with the first front rail and in spaced relationship therewith. The front side also comprised of a plurality of front rungs or steps. Each front rung being connected to the first front rail and the second front rail and perpendicular thereto. Each front rung in parallel and in spaced relationship with the other front rungs. The stepladder comprises a rear side. The rear side comprised of a first rear rail and a second rear rail in parallel with the first rear rail and in spaced relationship therewith. The rear side also comprised of a plurality of rear rungs. Each rear rung or horizontal is connected to the first rear rail and the second rear rail and perpendicular thereto. Each rear rung in parallel and in spaced relationship with the other rear rungs. The stepladder comprises a top. The front side and rear side fixedly attached to the top such that the front side and rear side can be folded together into a closed position where the front side and rear side are essentially in parallel or opened about the top into an operational position where the front side and rear side are at an angular relationship and a workman can climb to a desired rung and perform whatever work is desired. The stepladder comprises a pipe/tube holder attached to the rear side for holding pipe.

The present invention pertains to a stepladder. The stepladder comprises a front side. The front side comprised of a first front rail, and a second front rail in parallel with the first front rail and in spaced relationship therewith. The front side also comprised of a plurality of front rungs. Each front rung being connected to the first front rail and the second front rail and perpendicular thereto. Each front rung in parallel and in spaced relationship with the other front rungs. The stepladder comprises a rear side. The rear side comprised of a first rear rail and a second rear rail in parallel with the first rear rail and in spaced relationship therewith. The rear side also comprised of a plurality of rear rungs. Each rear rung connected to the first rear rail and the second rear rail and perpendicular thereto. Each rear rung in parallel and in spaced relationship with the other rear rungs. The stepladder comprises a top. The front side and rear side fixedly attached to the top such that the front side and rear side can be folded together into a closed position where the front side and rear side are essentially in parallel or opened about the top into an operational position where the front side and rear side are at an angular relationship and a workman can climb to a desired rung and perform whatever work is desired. The stepladder comprises a utility hook attached to the rear side.

The present invention pertains to a stepladder. The stepladder comprises a front side. The front side comprised of a first front rail, and a second front rail in parallel with the first front rail and in spaced relationship therewith. The front side also comprised of a plurality of front rungs. Each front rung being connected to the first front rail and the second front rail and perpendicular thereto. Each front rung in parallel and in spaced relationship with the other front rungs. The stepladder comprises a rear side. The rear side comprised of a first rear rail and a second rear rail in parallel with the first rear rail and in spaced relationship therewith. The rear side also comprised of a plurality of rear rungs. Each rear rung connected to the first rear rail and the second rear rail and perpendicular thereto. Each rear rung in parallel and in spaced relationship with the other rear rungs. The stepladder comprises a top. The front side and rear side fixedly attached to the top such that the front side and rear side can be folded together into a closed position where the front side and rear side are essentially in parallel or opened about the top into an operational position where the front side and rear side are at an angular relationship and a workman can climb to a desired rung and perform whatever work is desired. The stepladder comprises a strap bender attached to a rail or a rear rung through which a strap is inserted to be bent.

The present invention pertains to a stepladder. The stepladder comprises a front side. The front side comprised of a first front rail, and a second front rail in parallel with the first front rail and in spaced relationship therewith. The front side also comprised of a plurality of front rungs. Each front rung being connected to the first front rail and the second front rail and perpendicular thereto. Each front rung in parallel and in spaced relationship with the other front rungs. The stepladder comprises a rear side. The rear side comprised of a first rear rail and a second rear rail in parallel with the first rear rail and in spaced relationship therewith. The rear side also comprised of a plurality of rear rungs. Each rear rung connected to the first rear rail and the second rear rail and perpendicular thereto. Each rear rung in parallel and in spaced relationship with the other rear rungs. The stepladder comprises a top. The front side and rear side fixedly attached to the top such that the front side and rear side can be folded together into a closed position where the front side and rear side are essentially in parallel or opened about the top into an operational position where the front side and rear side are at an angular relationship and a workman can climb to a desired rung and perform whatever work is desired. The stepladder comprises a pipe/tube holder attached to the rear side for holding pipe. The stepladder comprises a strap bender attached to a rail or a rear rung through which a strap is inserted to be bent. The stepladder comprises a utility hook attached to the rear side.

The present invention pertains to a method for cutting a pipe. The method comprises the steps of moving a pipe/tube holder of a rear side of a stepladder into an open position. There is the step of placing the pipe on the pipe/tube holder. There is the step of cutting the pipe while it is on the pipe/tube holder.

The present invention pertains to a method for using a tool. The method comprises the steps of taking the tool off of a utility hook attached in proximity to a center of a rung of a rear side of a stepladder. There is the step of using the tool on an object.

The present invention pertains to a method for bending a strap. The method comprises the steps of placing a first end of a strap into an opening of a strap bender on a rail or rear rung of a stepladder. There is the step of bending the strap while its first end is in the strap bender.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
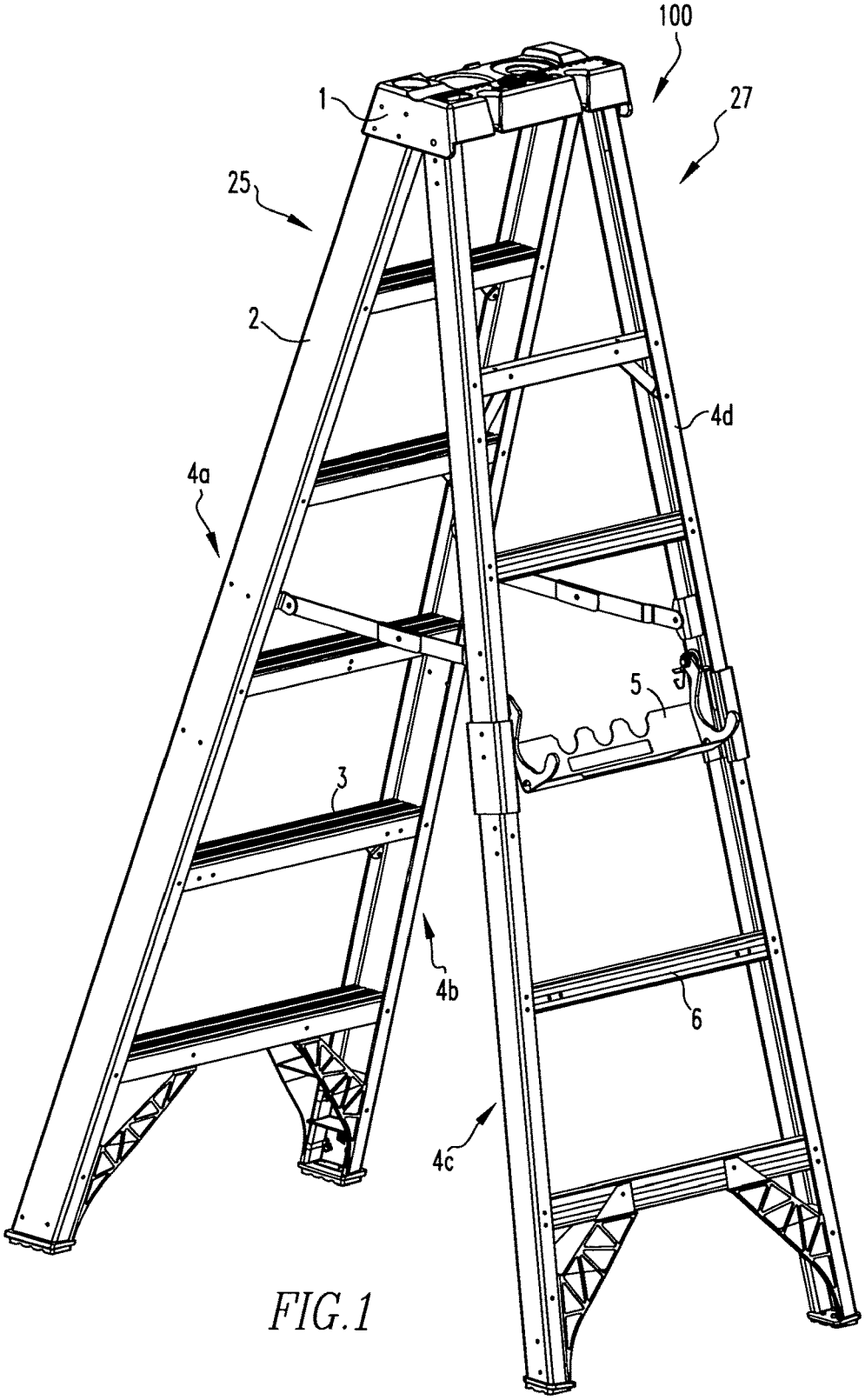
FIG. 1 is a schematic representation of a stepladder of the present invention.

Referring now to the drawings wherein like reference numerals refer to similar or identical parts throughout the several views, and more specifically to FIG. 1 thereof, there is shown a stepladder 100. The stepladder 100 comprises a front side 25. The front side 25 is comprised of a first front rail 4*a*, and a second front rail 4*b* in parallel with the first front rail 4*a* and in spaced relationship therewith. The front side 25 is also comprised of a plurality of front rungs. Each front rung being connected to the first front rail 4*a* and the second front rail 4*b* and perpendicular thereto. Each front rung in parallel and in spaced relationship with the other front rungs. The stepladder 100 comprises a rear side 27. The rear side 27 comprised of a first rear rail 4*c* and a second rear rail 4*d* in parallel with the first rear rail 4*c* and in spaced relationship therewith. The rear side 27 also comprised of a plurality of rear rungs. Each rear rung connected to the first rear rail 4*c* and the second rear rail 4*d* and perpendicular thereto. Each rear rung in parallel and in spaced relationship with the other rear rungs. The stepladder 100 comprises a top 1. The front side 25 and rear side 27 fixedly attached to the top 1 such that the front side 25 and rear side 27 can be folded together into a closed position where the front side 25 and rear side 27 are essentially in parallel or opened about the top 1 into an operational position where the front side 25 and rear side 27 are at an angular relationship and a workman can climb to a desired rung and perform whatever work is desired. The stepladder 100 comprises a pipe/tube holder 5 attached to the rear side 27 for holding pipe.

Preferably, the pipe/tube holder 5 includes a first side shield and a second side shield attached to the first rear rail 4*c* and the second rear rail 4*d* respectively, to protect the respective rear rail. The pipe/tube holder 5 preferably includes a first hook and a second hook, and a stamping 12 to which the first and second hooks are connected in alignment with each other; by moving the stamping 12, the first and second hooks move in unison with the stamping 12 between a retracted position and an open position. Preferably, the pipe/tube holder 5 includes a first mounting bracket connected to the first rear rail 4*c* and the first hook, and a second mounting bracket connected to the second rear rail 4*d* and the second hook. The stamping 12 preferably includes a scallop portion 8 upon which pipe can rest.

The present invention pertains to a stepladder 100. The stepladder 100 comprises a front side 25. The front side 25 comprised of a first front rail 4*a*, and a second front rail 4*b* in parallel with the first front rail 4*a* and in spaced relationship therewith. The front side 25 also comprised of a plurality of front rungs. Each front rung being connected to the first front rail 4*a* and the second front rail 4*b* and perpendicular thereto. Each front rung in parallel and in spaced relationship with the other front rungs. The stepladder 100 comprises a rear side 27. The rear side 27 comprised of a first rear rail 4*c* and a second rear rail 4*d* in parallel with the first rear rail 4*c* and in spaced relationship therewith. The rear side 27 also comprised of a plurality of rear rungs. Each rear rung connected to the first rear rail 4*c* and the second rear rail 4*d* and perpendicular thereto. Each rear rung in parallel and in spaced relationship with the other rear rungs. The stepladder 100 comprises a top 1. The front side 25 and rear side 27 fixedly attached to the top 1 such that the front side 25 and rear side 27 can be folded together into a closed position where the front side 25 and rear side 27 are essentially in parallel or opened about the top 1 into an operational position where the front side 25 and rear side 27 are at an angular relationship and a workman can climb to a desired rung and perform whatever work is desired. The stepladder 100 comprises a utility hook 11 attached to the rear side 27.

Preferably, the utility hook 11 is attached to the rear in proximity to the center of a rung of the rear side 27.

The present invention pertains to a stepladder 100. The stepladder 100 comprises a front side 25. The front side 25 comprised of a first front rail 4*a*, and a second front rail 4*b* in parallel with the first front rail 4*a* and in spaced relationship therewith. The front side 25 also comprised of a plurality of front rungs. Each front rung being connected to the first front rail 4*a* and the second front rail 4*b* and perpendicular thereto. Each front rung in parallel and in spaced relationship with the other front rungs. The stepladder 100 comprises a rear side 27. The rear side 27 comprised of a first rear rail 4*c* and a second rear rail 4*d* in parallel with the first rear rail 4*c* and in spaced relationship therewith. The rear side 27 also comprised of a plurality of rear rungs. Each rear rung connected to the first rear rail 4*c* and the second rear rail 4*d* and perpendicular thereto. Each rear rung in parallel and in spaced relationship with the other rear rungs. The stepladder 100 comprises a top 1. The front side 25 and rear side 27 fixedly attached to the top 1 such that the front side 25 and rear side 27 can be folded together into a closed position where the front side 25 and rear side 27 are essentially in parallel or opened about the top 1 into an operational position where the front side 25 and rear side 27 are at an angular relationship and a workman can climb to a desired rung and perform whatever work is desired. The stepladder 100 comprises a strap bender 16 attached to a rail or a rear rung through which a strap 17 is inserted to be bent.

The present invention pertains to a stepladder 100. The stepladder 100 comprises a front side 25. The front side 25 comprised of a first front rail 4*a*, and a second front rail 4*b* in parallel with the first front rail 4*a* and in spaced relationship therewith. The front side 25 also comprised of a plurality of front rungs. Each front rung being connected to the first front rail 4*a* and the second front rail 4*b* and perpendicular thereto. Each front rung in parallel and in spaced relationship with the other front rungs. The stepladder 100 comprises a rear side 27. The rear side 27 comprised of a first rear rail 4*c* and a second rear rail 4*d* in parallel with the first rear rail 4*c* and in spaced relationship therewith. The rear side 27 also comprised of a plurality of rear rungs. Each rear rung connected to the first rear rail 4*c* and the second rear rail 4*d* and perpendicular thereto. Each rear rung in parallel and in spaced relationship with the other rear rungs. The stepladder 100 comprises a top 1. The front side 25 and rear side 27 fixedly attached to the top 1 such that the front side 25 and rear side 27 can be folded together into a closed position where the front side 25 and rear side 27 are essentially in parallel or opened about the top 1 into an operational position where the front side 25 and rear side 27 are at an angular relationship and a workman can climb to a desired rung and perform whatever work is desired. The stepladder 100 comprises a pipe/tube holder 5 attached to the rear side 27 for holding pipe. The stepladder 100 comprises a strap bender 16 attached to a rail or a rear rung through which a strap 17 is inserted to be bent. The stepladder 100 comprises a utility hook 11 attached to the rear side 27.

The present invention pertains to a method for cutting a pipe. The method comprises the steps of moving a pipe/tube holder 5 of a rear side 27 of a stepladder 100 into an open position. There is the step of placing the pipe on the pipe/tube holder 5. There is the step of cutting the pipe while it is on the pipe/tube holder 5.

The present invention pertains to a method for using a tool. The method comprises the steps of taking the tool off of a utility hook 11 attached in proximity to a center of a rung of a rear side 27 of a stepladder 100. There is the step of using the tool on an object.

The present invention pertains to a method for bending a strap 17. The method comprises the steps of placing a first end of a strap 17 into an opening 15 of a strap bender 16 on a rail or rear rung of a stepladder 100. There is the step of bending the strap 17 while its first end is in the strap bender 16.

In the operation of the invention, the Pipe Trade stepladder 100 is a new ladder design based off of the IAA platform. There are new and innovative features that make up the new design. The new design has a plastic top 1 of FIG. 1, with features designed to benefit a plumber, as described in concurrently filed U.S. patent application titled "Pipe Tradesman Ladder Top", a pipe/tube holder 5 with side shields 10, and a utility hook 11.

The top 1 of FIG. 1 has many new features designed especially for the electrician. The top 1 has screw driver holes two hammer/drill holster and includes the Werner Tool Lasso system. Each of the features has a raised icon next to it for easy identification.

Figure 2:
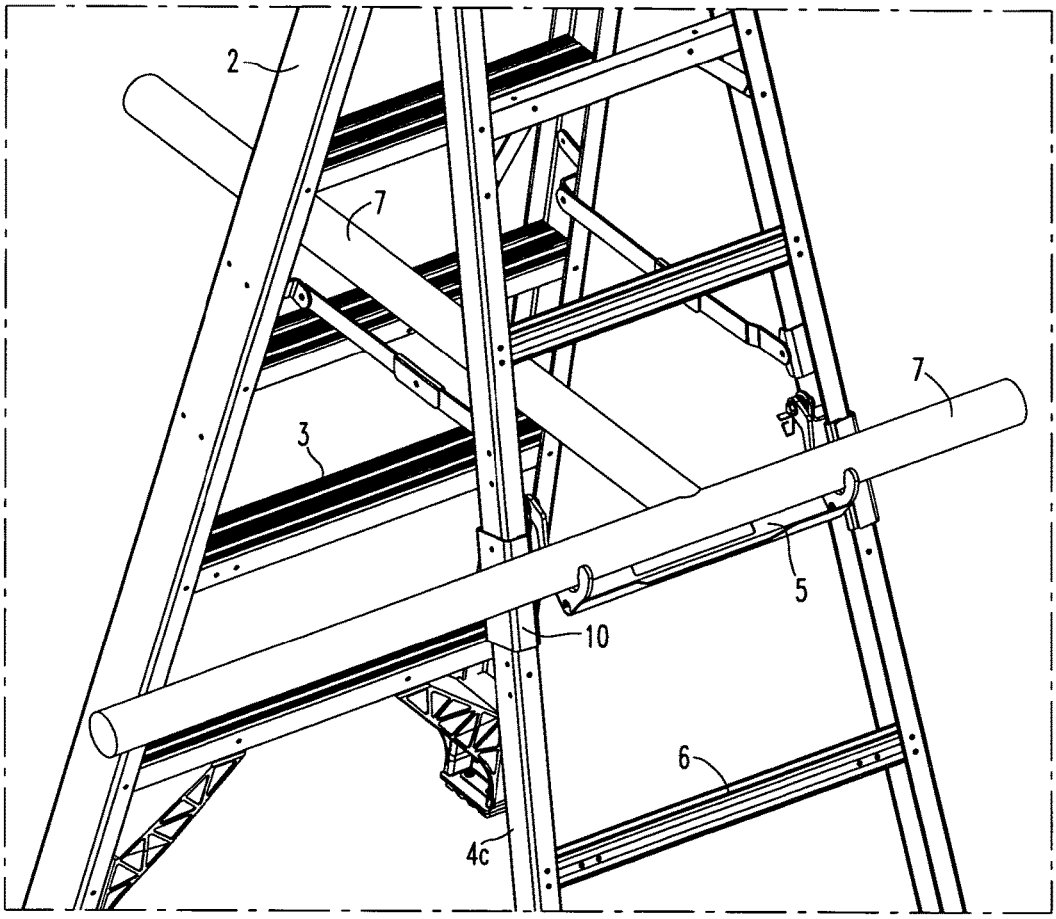
FIG. 2 is a schematic representation of a pipe/tube holder with pipe.
Figure 3:
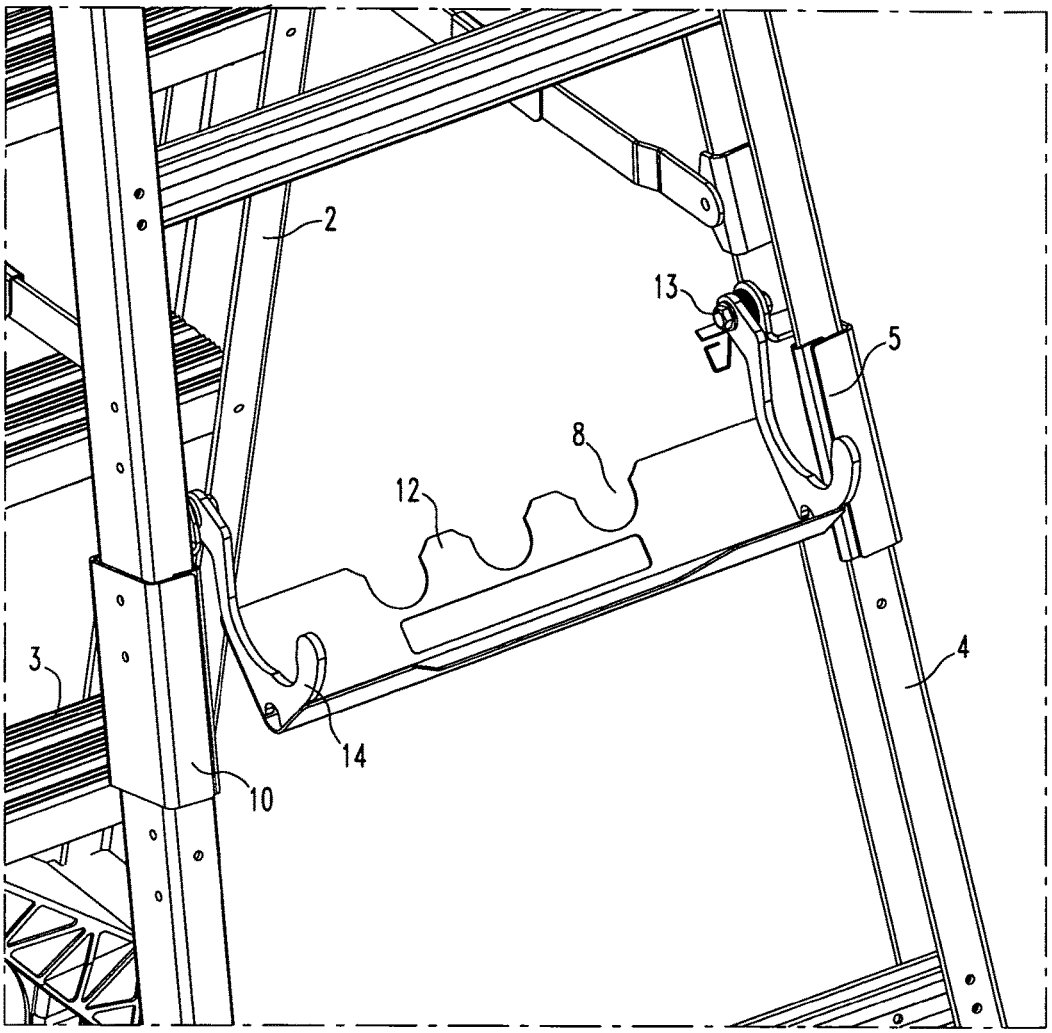
FIG. 3 is a schematic representation of a pipe/tube holder in an open position.

The pipe holder 5 of FIG. 2 is designed to hold various sizes of pipe/tubing 7 up to 2 inches in diameter. FIG. 3 shows the pipe/tubing holder 5 with pipe 7 in use. The hooks are connected by a steel stamping 12 and are mounted to the side rail 4 of the ladder with the mounting brackets 13. The steel stamping 12 connecting the two hooks 14 allows the user to operate both hooks 14 with one hand. This one handed operation allows for safer handling of materials and tools. Attached to the rail 4 are side shields 10. The side shields 10 wrap around the inside and the outside of the rail 4 and protect the rail 4 from being damaged by the pipe/tubing 7 or an errant cut by a hacksaw or PVC saw. As shown in FIG. 2, the pipe 7 can be held by the pipe holder 5 and another pipe 7 can be laid perpendicular to it resting on the front step 3 and the scallop portion 8 of the pipe holder 5. This allows the user a place to create and hold the necessary joints and fittings needed.

The pipe holder 5, as shown in FIG. 2, is designed to hold various sizes of pipe 7 up to one inch in diameter. The hooks 14 are connected by a stamping 12 and are mounted to the side rails 4 of the ladder 100 with the mounting brackets 9. The stamping 12 allows the user to operate both hooks 14 with one hand. This one-handed operation allows for safer handling of materials and tools. To use the pipe holder 5, the user has to pull the hooks 14 toward himself and then place the pipe 7 in the hooks 14. The pipe 7 then rests on the side shields 10. Once the pipe 7 is pulled out of the hooks 14, the hooks 14 will retract.

Figure 6:
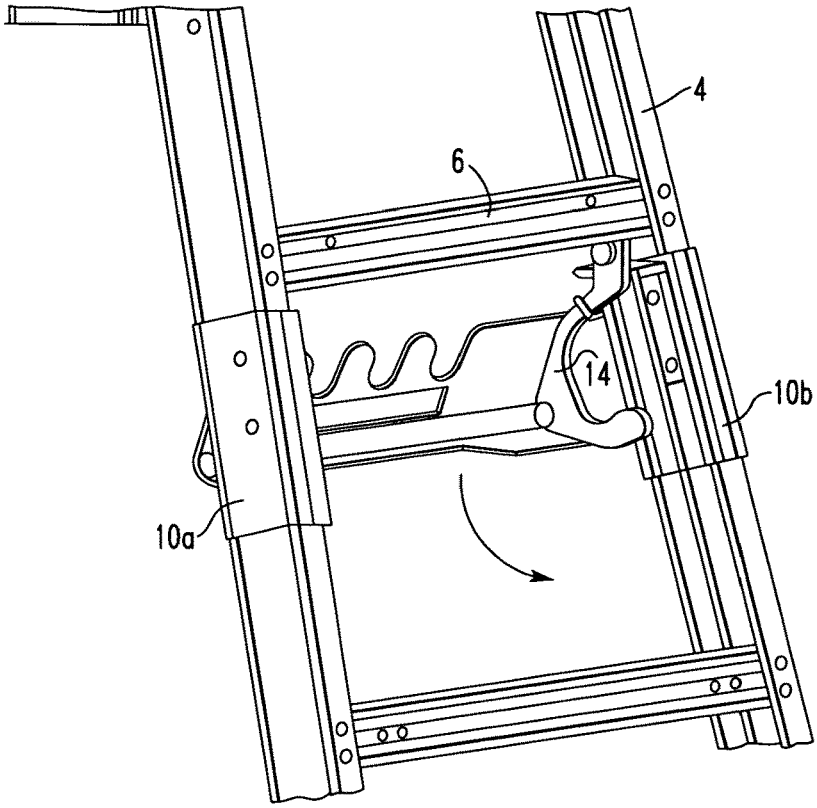
FIG. 6 is a schematic representation of the pipe/tube holder.
Figure 7:
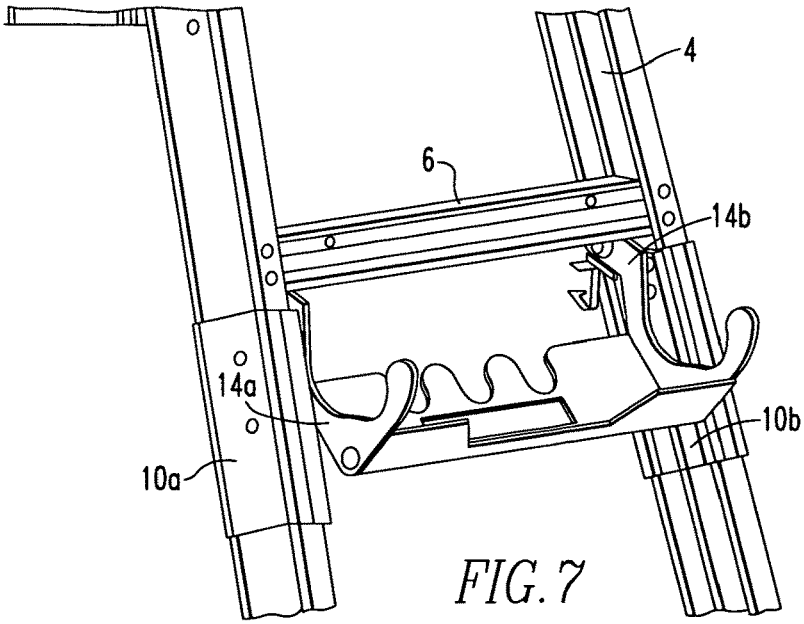
FIG. 7 is a schematic representation of the pipe/tube holder.

The pipe holder 5 is further described in FIGS. 6 and 7. The hooks 14 are welded to the stamping 12 which makes them move together. The pivot point 34 attaches the hooks 14 to the rail 4. The user will grab the hook 14 and pull it towards himself. The spring 35 automatically retracts the whole assembly when the user is done.

The pipe holder 5 is limited by the step 3, as shown in FIG. 2. The front of the step 3 will stop the holder when it is coming forward and the rear of step 3 will stop it when it retracts.

The new integrated pipe/tube holder 5 secures the work piece between the pipe/tube holder 5 hooks 14 and the protective rail shield for easy and safer cutting. The holder 5 can also be used to assemble and weld or glue pieces together prior to the final installation.

Figure 4:
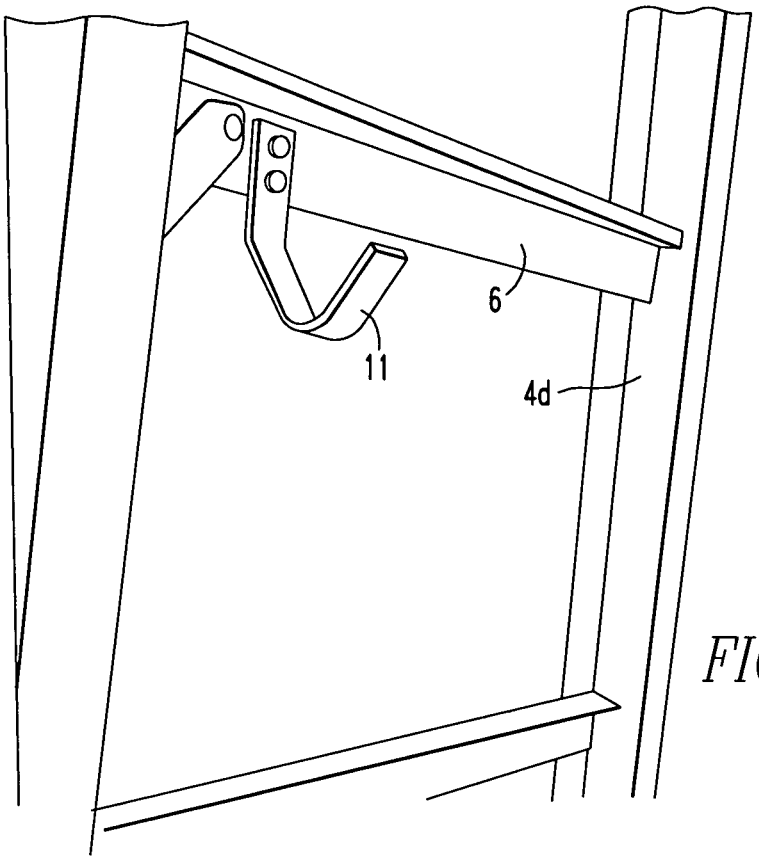
FIG. 4 is a schematic representation of the ladder with the utility hook.

Mounted on the rear horizontal 6 of FIG. 4 is the utility hook 11. This hook 11 is mounted on the $5^{th}$ rear horizontal from the bottom. The hook is designed to hold up to 35 pounds and has a variety of uses.

Users will tape or screw hooks 14 onto the outside of their ladder rail to hold tools and buckets when not in use. These hooks 14 are often mounted on the outside of the rail. They will then hang heavy tool belts and buckets that could tip the ladder over. The integrated utility hook 11 is placed in the inside of the frame on the center of the step 3 of the ladder so not to create a tipping hazard and is firmly secured to the step 3.

Figure 5:
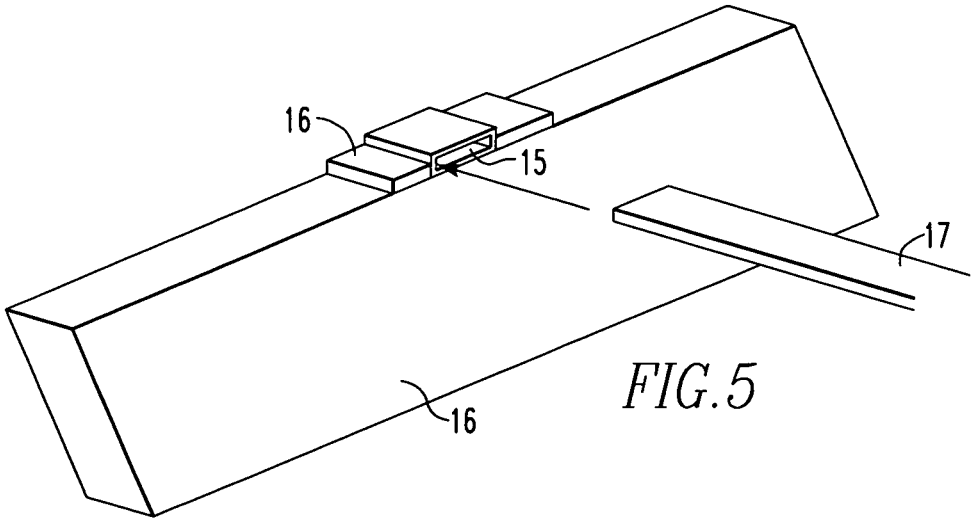
FIG. 5 is a schematic representation of the strap bender.

The strap bender 16 of FIG. 5 can be located on a horizontal 6 or a rail 4. The strap 17 that is to be bent is slid into the opening 15 on the strap bender 16. The user then bends the strap 17 to a 90 degree angle.

The strap bender 16 is a smaller steel part attached to the ladder. It is used to bend a 1 inch 90 degree end on a thin steel strap 17. These straps 17 are used on the heating and air conditioning ducts.

Figure 8:
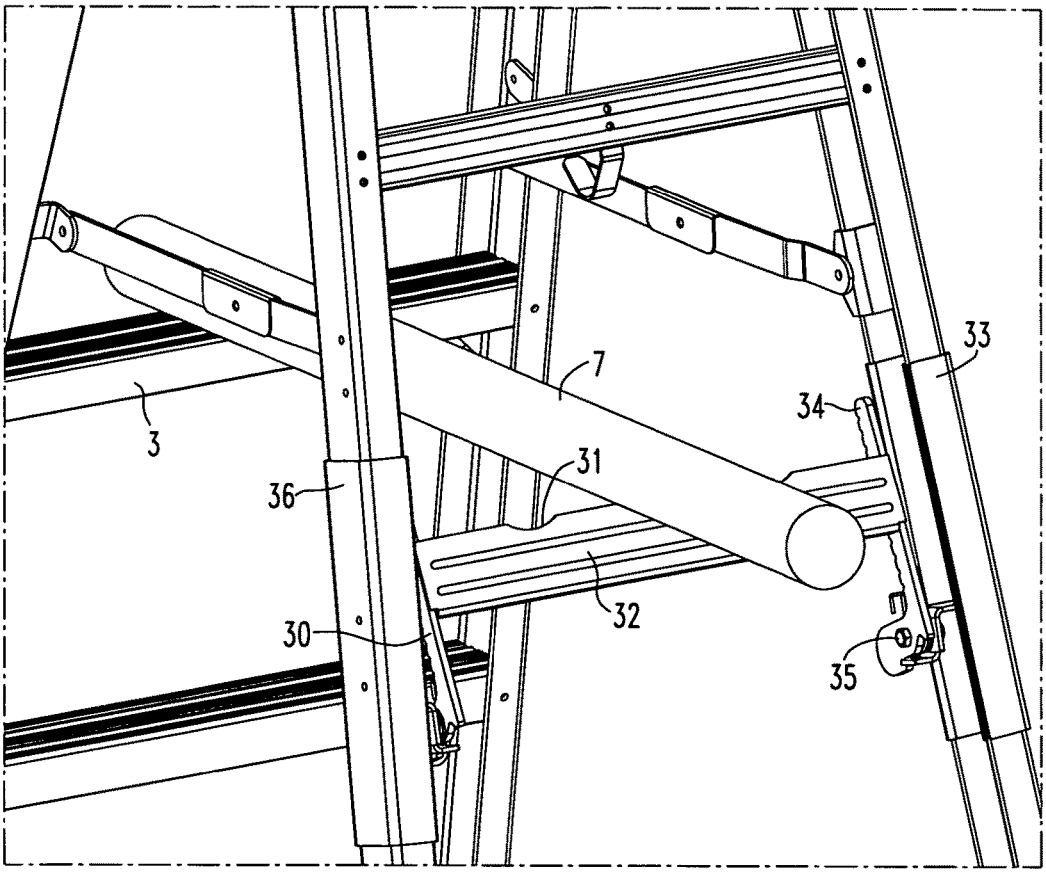
FIG. 8 is a schematic representation of an alternative embodiment of the pipe/tube holder.
Figure 9:
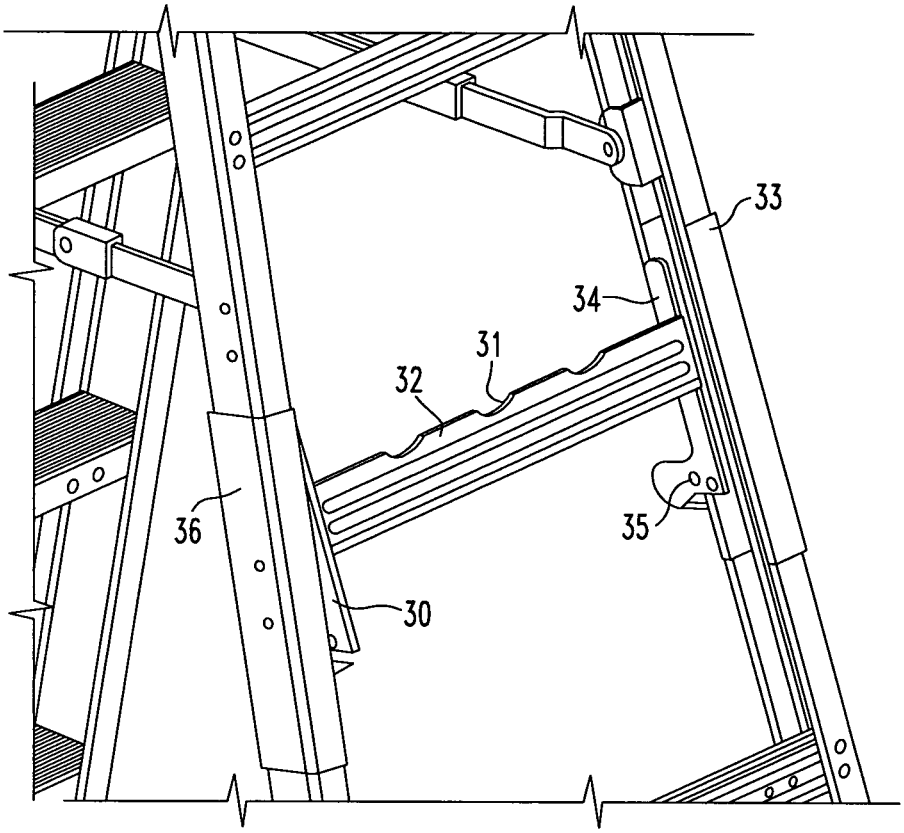
FIG. 9 is a schematic representation of an alternative embodiment of the pipe/tube holder in a retracted position.
Figure 10:
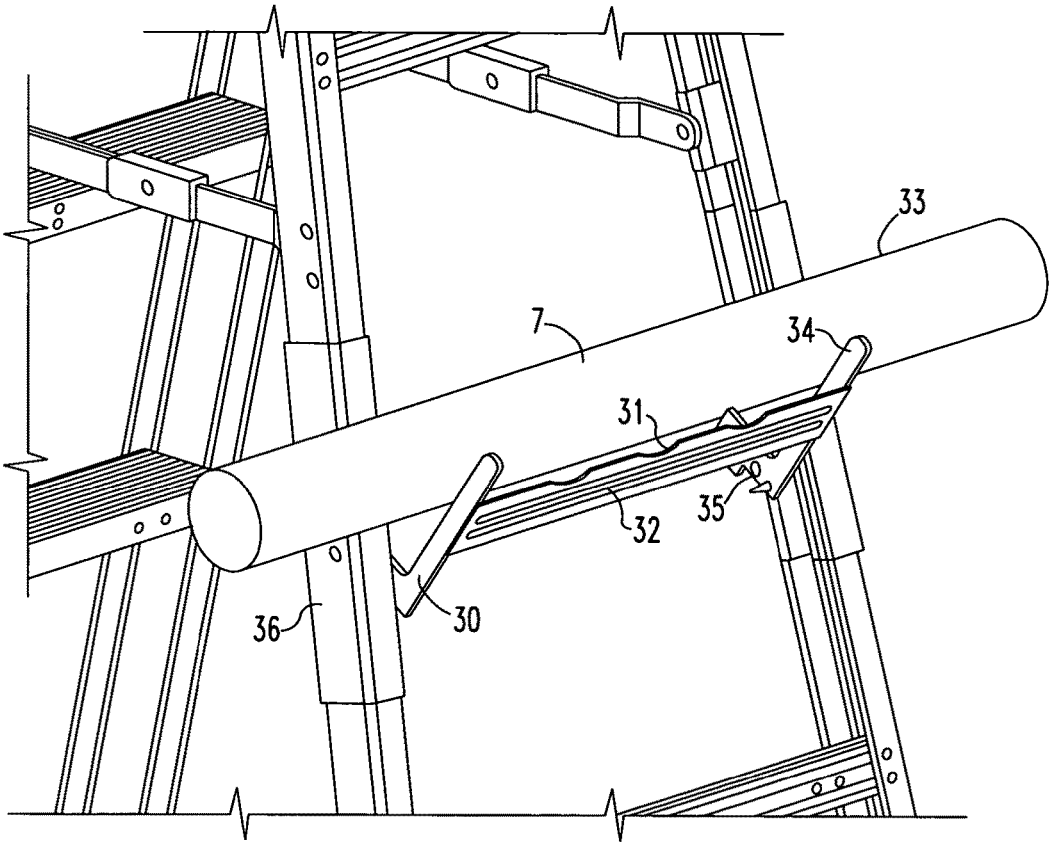
FIG. 10 is a schematic representation of an alternative embodiment of the pipe/tube holder in an open position.

In an alternative embodiment, the pipe holder is designed to hold various sizes of pipe/tubing 7 up to 3 inches in diameter. FIG. 8 shows the pipe/tubing holder with pipe 7 in use. The hooks 30, 34 are connected by a steel stamping 32. The steel stamping 32 connecting the two hooks 30, 34 allows the user to operate both hooks with one hand. This one handed operation allows for safer handling of materials and tools. Attached to the rail are side shields 33, 36. The side shields 33, 36 wrap around the inside and the outside of the rail and protect the rail from being damaged by the pipe/tubing 7 or an errant cut by a hacksaw or PVC saw. As shown in FIG. 8, the pipe 7 can be held by the front step 3 and the scalloped divot 31 in the steel stamping 32. This allows the user a place to create and hold the necessary joints and fittings needed prior to installation. The hooks 30, 34 rotate on 35 outward creating a "V" for the pipe 7 to rest between the hooks 34, 30 and the rail shields 33, 36, as shown in an open position in FIG. 10. The hooks 34 and 30 may have notches and or round cuts in them to better hold a pipe or bar shape. The hooks are shown in a retracted position in FIG. 9.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A stepladder comprising:

a front side, said front side comprised of a first front rail, and a second front rail in parallel with the first front rail and in spaced relationship therewith, said front side also comprised of a plurality of front rungs, each front rung being connected to the first front rail and the second front rail and perpendicular thereto, each front rung in parallel and in spaced relationship with the other front rungs;

a rear side, said rear side comprised of a first rear rail and a second rear rail in parallel with the first rear rail and in spaced relationship therewith, said rear side also comprised of a plurality of rear rungs, each rear rung connected to the first rear rail and the second rear rail and perpendicular thereto, each rear rung in parallel and in spaced relationship with the other rear rungs;

a top, said front side and rear side fixedly attached to the top such that the front side and rear side can be folded together into a closed position where the front side and rear side are essentially in parallel or opened about the top into an operational position where the front side and rear side are at an angular relationship and a workman can climb to a desired rung and perform whatever work is desired; and a pipe or tube holder rotatably connected to and disposed between the first rear rail and the second rear rail of the rear side which holds a tube or a pipe, the pipe or tube holder includes a first hook rotatably connected to the first rear rail and a second hook rotatably connected to the second rear rail, each hook having a C shape which conforms with a circular cross-sectional shape of the tube or pipe, the tube or pipe disposed in the C shape of each hook, and a stamping to which the first and second hooks are connected in alignment with each other, the stamping attached at the stamping's ends to a bottom of the C shape of the first and second hooks and extending therebetween, the stamping separate and apart from the rear side, the stamping attached to the first and second hooks; by rotating the stamping, the first and second hooks move in unison with the stamping between a retracted position and an open position, the first and second hooks hold a first pipe in parallel to the rear rungs when the first pipe is disposed on the first and second hooks, the stamping includes a scallop portion upon which a second pipe is held and rests perpendicular to the first pipe and contacts the first pipe when the second pipe is resting on the scallop portion so joints or fittings between the first pipe and second pipe can be created and held while the first pipe is held by the first and second hooks, the stamping having a flat plate, the scallop portion formed in the plate and having a circular slot extending down from a top edge of the plate which receives and conforms with a circular cross-sectional shape of the second pipe, the first and second hooks extending perpendicularly from the plate, the pipe or tube holder disposed below a rung of the rear side, in the retracted position, the stamping extending behind and in spaced relation with the rear side, in the open position, the stamping extending in front of and in spaced relationship with the rear side so the pipe is held by the first and second hooks in front of the rear side and a spring which automatically retracts the pipe or tube holder to the retracted position from the open position when the first pipe is moved from the first and second hooks, the first pipe maintains the pipe or tube holder in the open position when the first pipe is disposed on the first and second hooks which prevents the pipe or tube holder from retracting.

2. A stepladder as described in claim 1 wherein the pipe or tube holder includes a first side shield and a second side shield fixedly attached to the first rear rail and the second rear rail respectively, to protect the respective rear rail, each rail shield covering the respective rails web and flange outer surface.

3. A stepladder as described in claim 2 wherein the pipe or tube holder includes a first mounting bracket connected to the first rear rail and the first hook, and a second mounting bracket connected to the second rear rail and the second hook.

4. A stepladder comprising:

a front side, said front side comprised of a first front rail, and a second front rail in parallel with the first front rail and in spaced relationship therewith, said front side also comprised of a plurality of front rungs, each front rung being connected to the first front rail and the second front rail and perpendicular thereto, each front rung in parallel and in spaced relationship with the other front rungs;

a rear side, said rear side comprised of a first rear rail and a second rear rail in parallel with the first rear rail and in spaced relationship therewith, said rear side also comprised of a plurality of rear rungs, each rear rung connected to the first rear rail and the second rear rail and perpendicular thereto, each rear rung in parallel and in spaced relationship with the other rear rungs;

a top, said front side and rear side fixedly attached to the top such that the front side and rear side can be folded together into a closed position where the front side and rear side are essentially in parallel or opened about the top into an operational position where the front side and rear side are at an angular relationship and a workman can climb to a desired rung and perform whatever work is desired, the front side and the rear side and the top together defining a frame;

a pipe or tube holder fixedly attached to the first rear rail and the second rear rail of the rear side which holds a tube or a pipe, the pipe or tube holder includes a first hook rotatably connected to the first rear rail and a second hook rotatably connected to the second rear rail, each hook having a C shape which conforms with a circular cross-sectional shape of the tube or pipe, the tube or pipe disposed in the C shape of each hook, and a stamping to which the first and second hooks are connected in alignment with each other, the stamping separate and apart from the rear side, the stamping attached to the first and second hooks, the stamping attached at the stamping's ends to a bottom of the C shape of the first and second hooks and extending therebetween; by rotating the stamping, the first and second hooks move in unison with the stamping between a retracted position and an open position, the first and second hooks hold a first pipe in parallel to the rear rungs when the first pipe is disposed on the first and second hooks, the stamping includes a scallop portion upon which a second pipe is held and rests perpendicular to the first pipe and contacts the first pipe when the second pipe is resting on the scallop portion so joints or fittings between the first pipe and second pipe can be created and held while the first pipe is held by the first and second hooks, the stamping having a flat plate, the scallop portion formed in the plate and having a circular slot extending down from a top edge of the plate which receives and conforms with a circular cross-sectional shape of the second pipe, the first and second hooks extending perpendicularly from the plate, and a spring which automatically retracts the pipe or tube holder to the retracted position from the open position when the first pipe is moved from the first and second hooks, the first pipe maintains the pipe or tube holder in the open position when the first pipe is disposed on the first and second hooks which prevents the pipe or tube holder from retracting;

a metal strap bender made of metal attached to a rail or a rear rung, the strap bender having a rectangular shaped opening through which a metal strap is inserted to be bent, the bender configured to be used to bend the metal strap 90°; and a utility hook fixedly attached to either the front or rear side and positioned between the front side and rear side and inside the frame when the front and rear sides are in the operational position so as not to create a tipping hazard.

* * * * *